US009820599B1

(12) United States Patent
Goldman et al.

(10) Patent No.: US 9,820,599 B1
(45) Date of Patent: Nov. 21, 2017

(54) COLLAPSIBLE HOOK HANGER

(71) Applicant: Uniplast Industries, Inc., Hasbrouck Heights, NJ (US)

(72) Inventors: Stuart Goldman, Wayne, NJ (US); King Keung Kennedy Chan, Pokfulam (HK)

(73) Assignee: UNIPLAST INDUSTRIES, INC., Hasbrouck Heights, NJ (US)

( * ) Notice: Subject to any disclaimer, the term of this patent is extended or adjusted under 35 U.S.C. 154(b) by 0 days.

(21) Appl. No.: 15/151,051

(22) Filed: May 10, 2016

(51) Int. Cl.
*A41D 27/22* (2006.01)
*A47G 25/32* (2006.01)
*A47G 25/14* (2006.01)

(52) U.S. Cl.
CPC ..... *A47G 25/32* (2013.01); *A47G 25/1428* (2013.01)

(58) Field of Classification Search
CPC ..... A47G 25/32; A47G 25/1407; A47G 25/1414; A47G 25/1428
USPC ..... 223/85, 88, 92, DIG. 4, 89, 94; 40/322
See application file for complete search history.

(56) References Cited

U.S. PATENT DOCUMENTS 5,074,445 A * 12/1991 Chen ..... A47G 25/32 211/116
5,085,357 A * 2/1992 Chen ..... A47G 25/4038 223/85
6,000,587 A * 12/1999 Sackett ..... A47G 25/32 223/85
7,837,074 B2 * 11/2010 Rude ..... A47G 25/32 223/85
8,113,393 B2 2/2012 Ho
2016/0088964 A1 3/2016 Hansen et al.
2016/0088965 A1 3/2016 Hansen et al.

* cited by examiner

*Primary Examiner* — Nathan Durham
(74) *Attorney, Agent, or Firm* — Leason Ellis LLP

(57) ABSTRACT

A collapsible hook hanger includes a hook having a threaded end and a hanger body including a cross bar having a top edge. A hook receiving body extends from the top edge of the cross bar and is defined by a first side wall and an opposing second side wall. An inner surface of the second side wall includes a recess that is located opposite a through hole formed in the first side wall. The hook receiving body has a hook receiving slot for receiving the hook. An axle member is rotatably disposed within the through hole of the first side wall and is rotatably contained within the through hole. The axle member includes a threaded bore that receives the threaded end of the hook which is securely coupled to the axle member. The axle member is snap-fittingly attached to the hook receiving body while permitting free rotation of the axle member within the hook receiving body.

13 Claims, 11 Drawing Sheets

COLLAPSIBLE HOOK HANGER

TECHNICAL FIELD

The present invention relates to garment hangers and more particularly, to a garment hanger having a collapsible hook.

BACKGROUND

There are a number of different types of garment hangers that are used to hold a number of different articles of clothing or other types of articles, such as linens or other household fabrics. Typically, garment hangers are either formed of a plastic material or a metal material or a combination thereof. Not only do garment hangers come in a variety of different sizes but they also come in a number of different styles that have different types of constructions to accommodate different articles that are carried by the hangers.

A traditional type of garment hanger includes a metal hook which is received in and mates to a threaded boss located on the upper frame. More specifically, one end of the metal hook is a threaded end that mates with the threaded boss. The body of the hanger is typically made of plastic.

Many times, garments that are manufactured overseas are pre-hung on a hanger and then shipped to another country as a garment/hanger combination. Upon delivery to the final retail location, the garment is simply removed from the box (packaging) and hung in the retail location. Since shipping and transportation costs are not insignificant, it is desirable to pack the garments as tight as possible in the packaging boxes/containers. However, the hooks of the garment hangers take up a significant volume of space within the packaging boxes/containers. This additional space, of course, translates into additional shipping costs.

There is therefore a need for a garment hanger that operates as a conventional hanger but is also capable of providing a reduced footprint during packaging/transportation.

SUMMARY

A collapsible hook hanger includes a hook having a threaded end and a hanger body including a cross bar having a top edge. The collapsible hook hanger also includes a hook receiving body extending from the top edge of the cross bar. The hook receiving body is defined by a first side wall and an opposing second side wall, wherein an inner surface of the second side wall includes a recess that is located opposite a through hole formed in the first side wall. The hook receiving body has a hook receiving slot for receiving the hook.

The collapsible hook hanger also includes an axle member that has: (1) a first portion that is rotatably disposed within the through hole of the first side wall; (2) a second portion that includes a threaded bore that is in communication with the hook receiving slot for receiving and mating to the threaded end of the hook; and (3) a third portion that is rotatably received within the recess in the second side wall. The axle member includes a locking feature that interlocks with the first side wall resulting in the axle member being rotatably captured within the hook receiving body. The hook is rotatable between a first upright position and a second folded position.

BRIEF DESCRIPTION OF THE DRAWING FIGURES

DETAILED DESCRIPTION OF CERTAIN EMBODIMENTS

Figure 1:
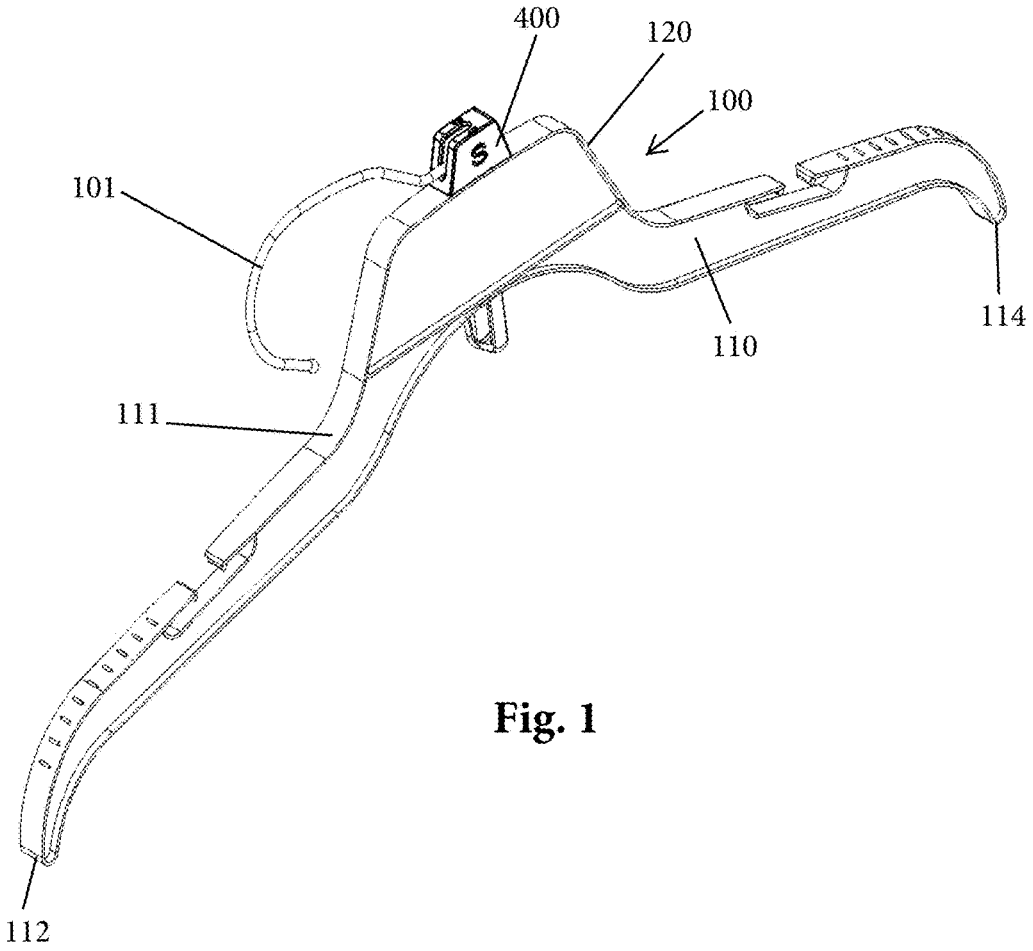
FIG. 1 is a top and side perspective view of a garment hanger with a collapsible hook.
Figure 2:
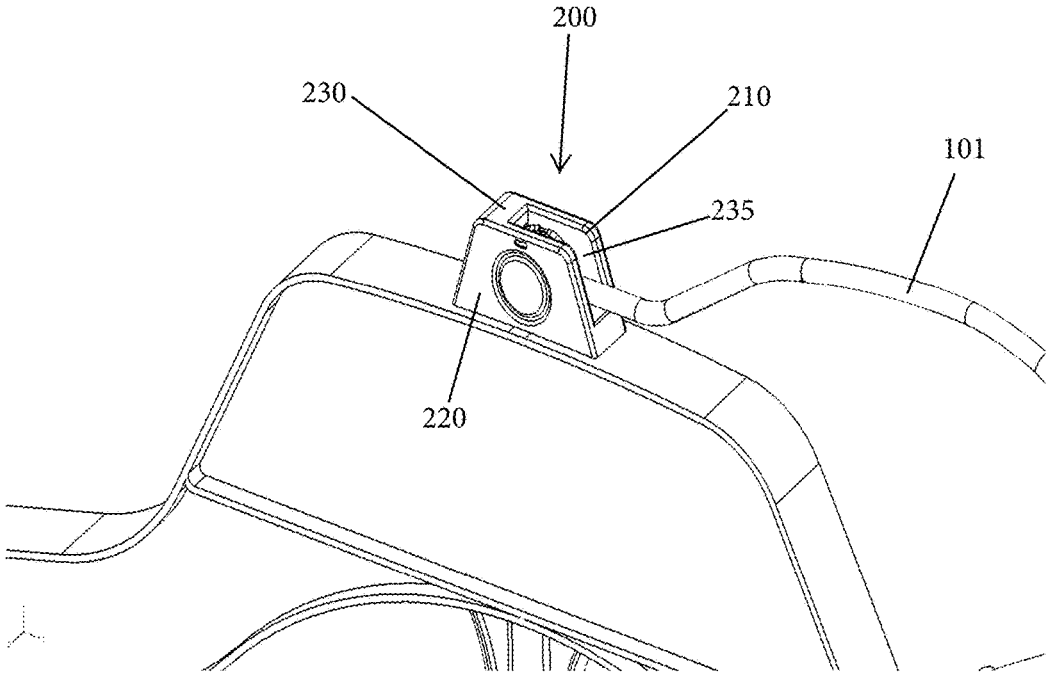
FIG. 2 is a close-up first side perspective view of a hook receiving body that mates with a hook of the hanger.
Figure 3:
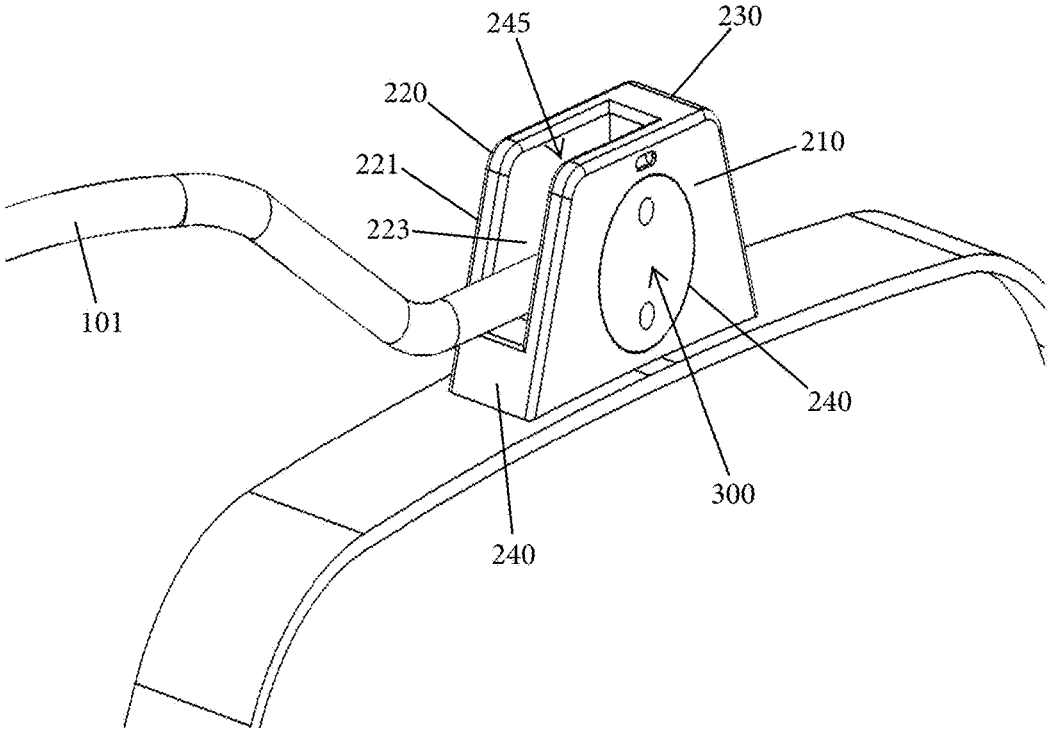
FIG. 3 is a close-up second side perspective view of the hook receiving body.
Figure 4:
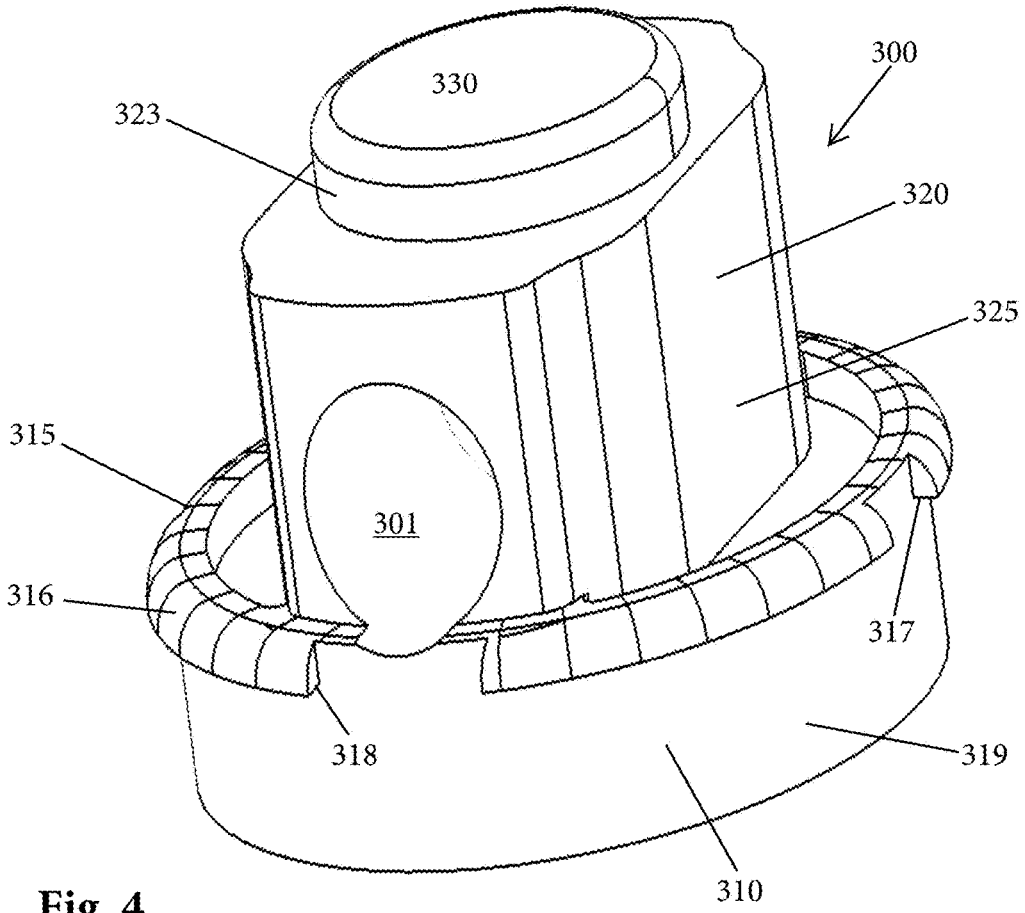
FIGS. 4-6 are perspective views of an axle member that is rotatably received in the hook receiving body.
Figure 5:
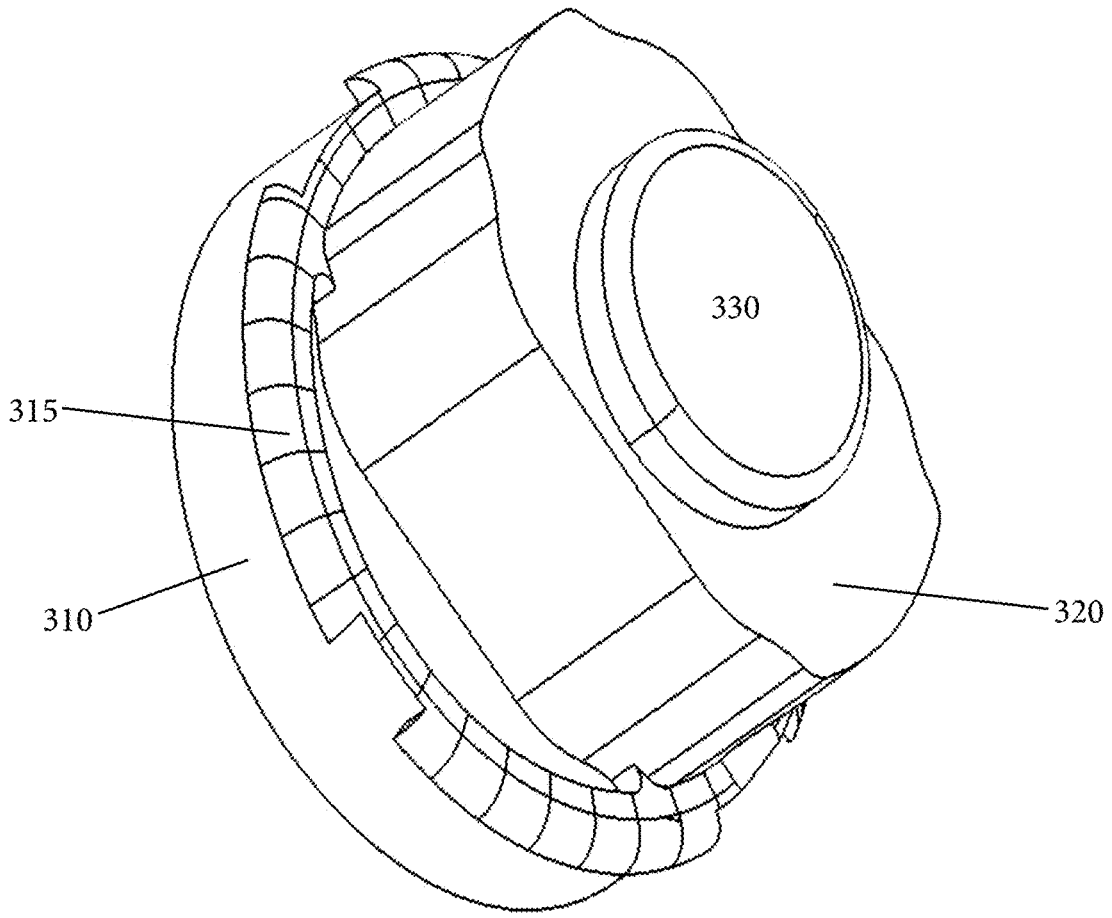
Figure 6:
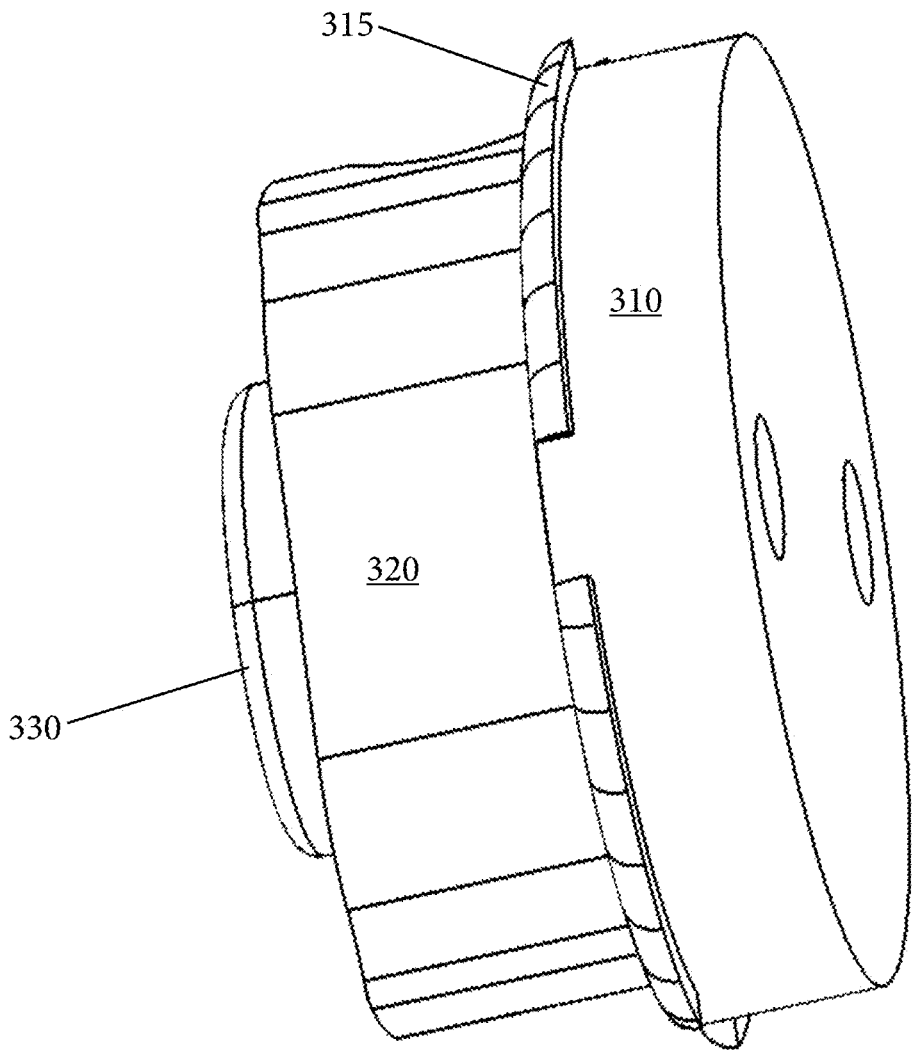

FIGS. 1-3, 7 and 8 illustrate an exemplary garment hanger 100 that includes a crossbar 110 that defines a first end 112 and an opposing second end 114. Hanger 100 also includes a central portion 120 that defines a hook receiving area. In particular, the central portion 120 includes a hook receiving body 200 that is integral to and extends outwardly from a top edge 111 of the cross bar 110.

The hook receiving body 200 is defined by a first side wall 210, an opposing second side wall 220, a first end wall 230 that connects the first side wall 210 and the second side wall 220, and a second end wall 240 that also connects the first side wall 210 and the second side wall 220. The first and second side walls 210, 220 are parallel to one another and the first side wall 210 can be thought of as being a front wall and the second side wall 220 can be thought of as being a rear wall. The first and second end walls 230, 240 can be angled (other than 90 degrees) relative to the top edge of the cross bar 110.

The four walls 210, 220, 230, 240 define a hollow interior space 245 that is open along its top since there is no wall structure that extends across the top edges of the four walls 210, 220, 230, 240. Thus, the hook receiving body 200 includes a top opening 201 which, as described below, is configured to receive a hook 101.

The first end wall 230 can be a completely solid wall that extends between the first and second side walls 210, 220. In contrast, the second end wall 240 includes an opening that communicates with the top opening so as to define a generally L-shaped hook receiving slot 235.

The first side wall 210 has an opening 240 formed therein. More specifically, the opening 240 defines an entrance into the hollow interior space 245 defined within the hook receiving body 210. The opening 240 is a through hole that can have any number of different shapes and in the illustrated embodiment, the opening 240 has a generally circular shape. The opening 240 can be centrally formed in the first side wall 210.

The opposing second side wall 220 has an exterior surface 221 and an opposing interior surface 223. The second side wall 220 is a completely solid structure unlike the first side wall 210 that includes the opening 240. The exterior surface 221 is preferably a smooth surface, while the interior surface 223 has a recess 250 integrally formed therein. The recess 250 has a defined shape and size. It will be appreciated that the recess 250 can have any number of different shapes and different sizes and in the illustrated embodiment, the recess 250 has a generally circular shape. The recess 250 also has a selected depth as described herein; however, the recess 250 is not a through hole as shown. Recess 250 includes a floor 251.

The recess 250 is axially formed with the opening 240 and in one embodiment, the axis is a central axis that passes through the centers of both the recess 250 and the opening 240 even though the size of the recess 250 is different than the size of the opening 240. As shown, the recess 250 has a smaller diameter relative to the diameter of the opening 240.

The garment hanger 100 also includes an axle member 300 that is configured to be securely attached to the hook of the hanger. As mentioned, the hook is often formed of metal and has a threaded end. The axle member 300 is a substantially solid structure; however, the axle member 300 does include a threaded bore 301 which is configured to receive the threaded end of the hook so as to securely attach the hook to the axle member 300. It is possible that the axle member 300 can be thought of as being a plug or a barrel.

As shown in the figures, the axle member 300 can be thought of as an integral multi-portioned structure. In other words, the axle member 300 has a series of stacked sections (portions) as described herein. More specifically, the axle member 300 includes a first section 310, a second section 320 and a third section 330, with the second section 320 being located between the first and third sections 310, 330.

The third section 330 is configured to be intimately received within the recess 250 with an outer face 331 thereof seating against floor 251 of recess 250. The third section 330 is rotatably received within the recess 250 and therefore has a complementary shape and size relative to the shape and size of the recess 250. In the illustrated embodiment, the recess 250 has a circular shape and thus, the third section 330 which is in the form of a protrusion that extends outwardly from one face of the second section 320 also has a circular shape.

The shape of the third section 330 is selected such that the third section 330 is free to rotate within the recess 250. The fit between the third section 330 and the recess 250 assists in holding the axle member 200 in place within the hollow interior space 245. As shown in the figures, the thickness (height) of the third section 330 is much less than the thicknesses of each of the second section 320 and the first section 310. In other words, the thickness of the third section 330 is selected so as to securely and rotatably couple the axle member 300 to the hook receiving body 200 without having the third section 330 inadvertently slip or otherwise fall out of the recess 250 during rotation therein, etc.

When the axle member 300 is inserted into the hollow interior space 245, the third section 330 represents the innermost section of the axle member 300, while the first section 310 represents the outermost section of the axle member 300 which is visible within the opening 240 of the first side wall 210.

The second section 320 can have any number of different shapes and in the illustrated embodiment, the second section 320 has an oblong or oval shape. The shape of the second section 320 is at least in part dictated by the fact that the second section 320 is the portion that receives the threaded end of the hook. The second section 320 thus contains the threaded bore 301 that threadingly mates with the threaded end of the hook so as to securely attach the hook to the axle member 300. As shown, the threaded bore 301 is formed in one end of the second section 320.

As shown, the second section 320 has a greater footprint than the third section 330 and actually surrounds the third section 330. A first shoulder 323 is formed between the second section 320 and the third section 330. A second shoulder 325 is formed between the second section 320 and the first section 310.

The first section 310 is configured to be received within the opening 240. The illustrated first section 310 has a disk shaped base 319 (e.g., circular shaped section) with the second section 320 being integral thereto and extending outwardly from one face 311 of the disk shaped base 319 of the first section 310. The face 311 of the disk shaped base 319 includes a peripheral rim (locking ridge) 315 that extends around a periphery of the first section 310 at the face 311. The peripheral rim 315 extends radially outward from the face 311 of the disk shaped base 319 so as to create the peripheral rim 315 which overhangs the remaining body 319 of the first section 310. Since the illustrated first section 310 has a circular shape, the illustrated peripheral rim 315 likewise has a circular shape. As shown, the peripheral rim 315 can include a plurality of notches 317 formed therein and spaced apart from one another. As shown in the figures, the peripheral rim 315 extends not only above the face 311 but also extend radially outward therefrom so as to create the overhang.

The peripheral rim 315 can generally have a general triangular shape as shown. This triangular shape is thus defined by a beveled/sloped edge 316 and a flat undercut edge 318. The undercut edge 318 lies in a plane that is parallel to the plane that contains the face 311.

The peripheral rim 315 acts as a locking ridge to securely attach the axle member 300 within the hollow interior space 245 of the hook receiving body 200 yet still permit the axle member 300 to freely rotate within the interior space 245 so as to allow the axle member 300 to assume one of a plurality of positions which when the hook is attached to the hook receiving body 200 allows the pivot relative to the hook receiving body 200. This pivoting action of the hook receiving body 200 translates into pivoting of the hook between an extended (upright) position and a collapsed (folded) position. In particular, the disk shaped base 319 has dimensions (e.g., diameter) that is only slightly less than the dimensions (e.g., diameter) of the opening 240; however, the peripheral rim 315 has dimensions (e.g., diameter) that is slightly greater than the dimensions (e.g., diameter) of the opening 240. The peripheral rim 315 is configured and formed of a material (e.g., plastic) that allows for at least slight flexing thereof to allow a mechanical (interference) fit to be achieved between the axle member 300 and the hook receiving body 200. More specifically, when the axle member 300 is inserted into the hollow interior space 245 through the opening 240, the beveled edge 316 first contacts the outer face of the first side wall 210 and due to its beveled nature, the edge 316 acts as a cam, thereby causing a flexing of the peripheral rim 315.

Figure 7:
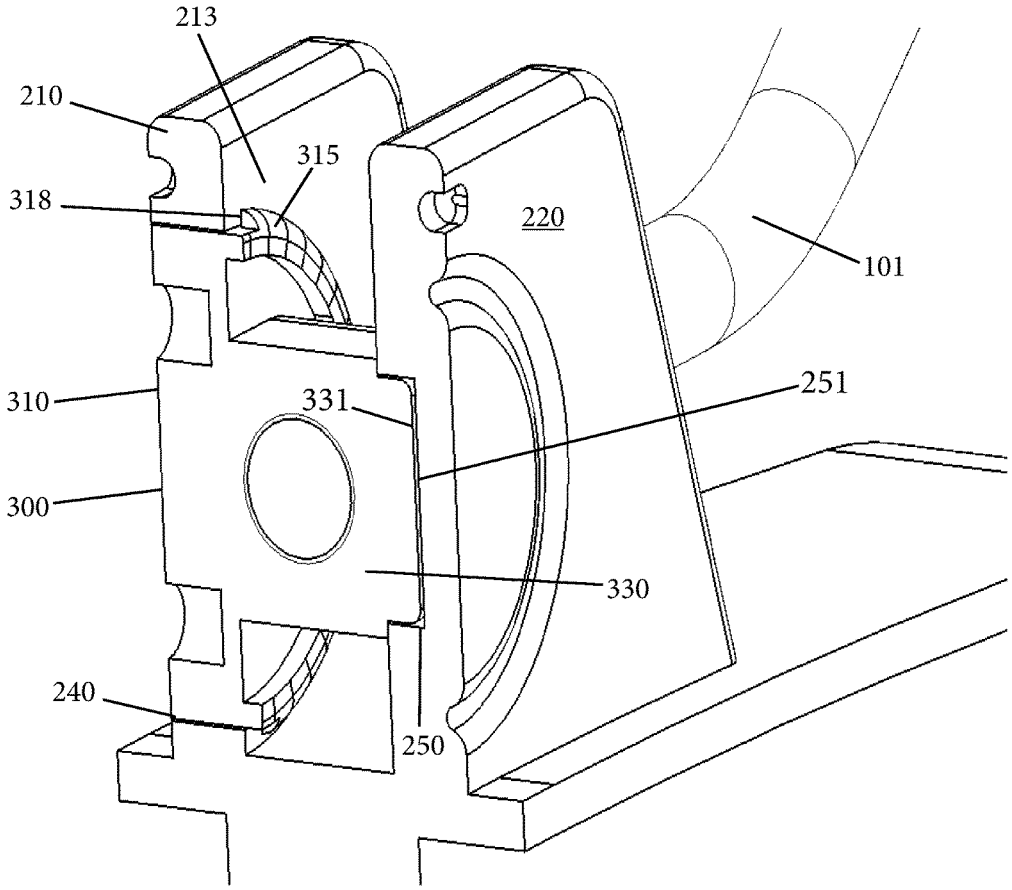
FIGS. 7-8 are cross-sectional views through the hook receiving body and axle member attached thereto.
Figure 8:
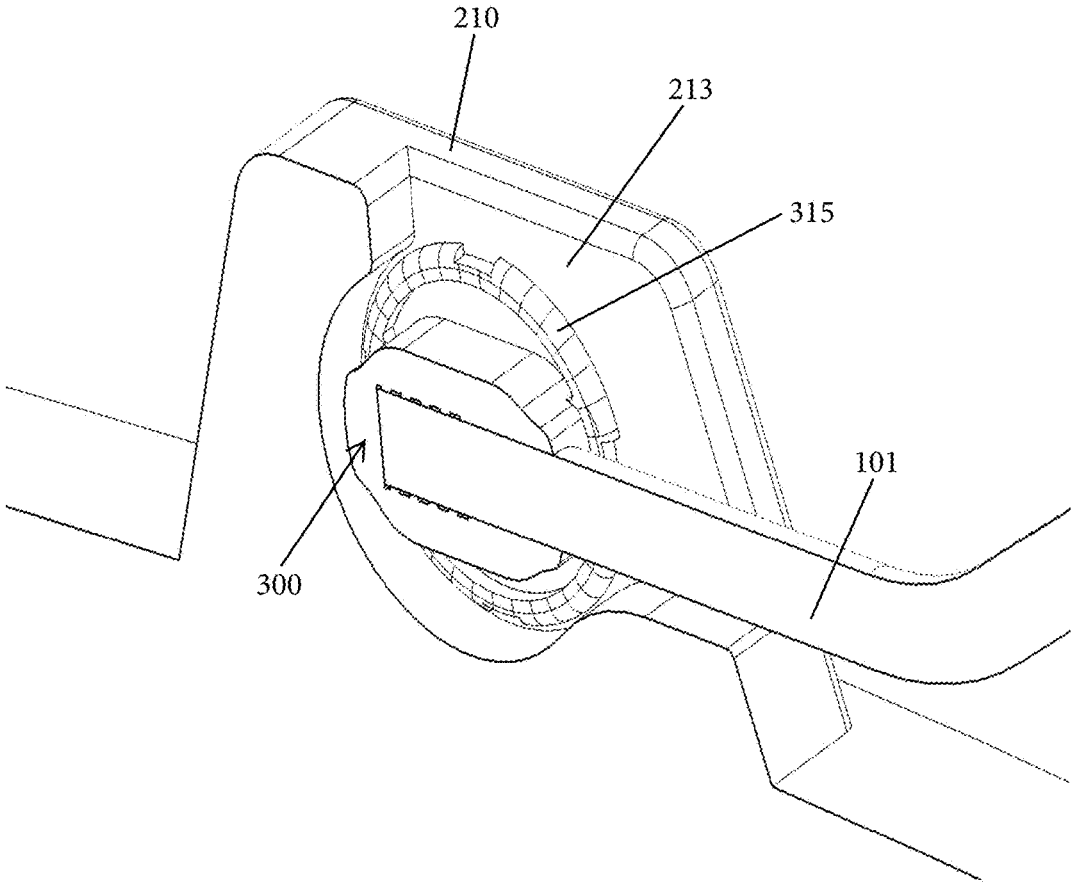

Once the axle member 300 is inserted a sufficient distance, as described below, the peripheral rim 315 clears an inner face 213 of the first side wall 210, the peripheral rim 315 flexes outward to return to its at rest (relaxed) position. As shown in FIG. 7, when the peripheral rim 315 assumes this locked position, the undercut edge 318 seats against the inner face 213 of the first side wall 210. Thus, a snap fit results between the axle member 300 and the hook receiving body 200. This locking action results in the axle member 300 being locked in place within the hook receiving body 200 yet still permits the axle member 300 to freely rotate within the hook receiving body 200.

The complete manner of coupling the axle member 300 to the hook receiving body 200 is now described. The axle member 300 is first positioned such that the third section 330 faces the first side wall 210. The axle member 300 is then passed through the opening 240 with the third section 330 being inserted first into the hollow interior space 245. The third section 330 is then directed to and inserted into the recess 250. The third section 330 thus acts as a protrusion that seats within the recess 250. As mentioned, the third section 330 can thus be thought of as a hub that locates and stabilizes the axle member 300 within the hook receiving body 200, while still permitting rotation of the axle member 300.

As the third section 330 travels within the hollow interior space 245 toward the recess 250, the peripheral rim 315 engages the first side wall 210, as described herein, with the peripheral rim 315 flexing to permit insertion of the axle member 300 into the hollow interior space 245. At the time that the peripheral rim 315 clears the first side wall 210, the third section 330 is rotatably contained within the recess 250.

The containment of the third section 330 in the recess 250 secures the inner end portion of the axle member 300 within the hook receiving body 200 and the peripheral rim 315 and the containment of the axle member 300 within the opening 240 secures the outer end portion of the axle member 300 within the hook receiving body 200. The locking of the peripheral rim 315 prevents any unintended dislodgment of the axle member 300 from the hook receiving body 200. The axle member 300 is thus held in a generally perpendicular orientation relative to the side walls 210, 220. In this manner, the axle member 300 is contained and supported within the hook receiving body 200. Preferably, when the axle member 300 is fully inserted and locked in place within the hook receiving body 200, the outer surface (face) of the first section 310 lies at least substantially flush with or slightly recessed with respect to the first side wall 210.

The axle member 300 is thus locked in place (e.g., snap fit) by inserting the axle member 300 into the hollow interior space 245. An audible click or at least a tactile click is felt when the axle member 300 is inserted into and locks with the hook receiving body 200. As shown in the figures, when the axle member 300 is locked in place in the hook receiving body 200, the threaded bore 321 and is axially aligned with and in communication with the hook receiving slot 235 so as to permit the hook to be inserted into and pass through the hook receiving slot 235, thereby allowing the hook to mate to and move with the axle member 300. It will be appreciated that the ends of the hook receiving slot 235 define the ends of travel for the hook. One end of the hook receiving slot 235 is located such that when the hook is positioned at this end, the hook is in a fully extended position in which the hook is generally perpendicular to the cross bar 110. Conversely, when the hook is at the other end of the hook receiving slot 235, the hook is in a fully collapsed position and the hook is oriented generally parallel to the cross bar 110.

Figure 9:
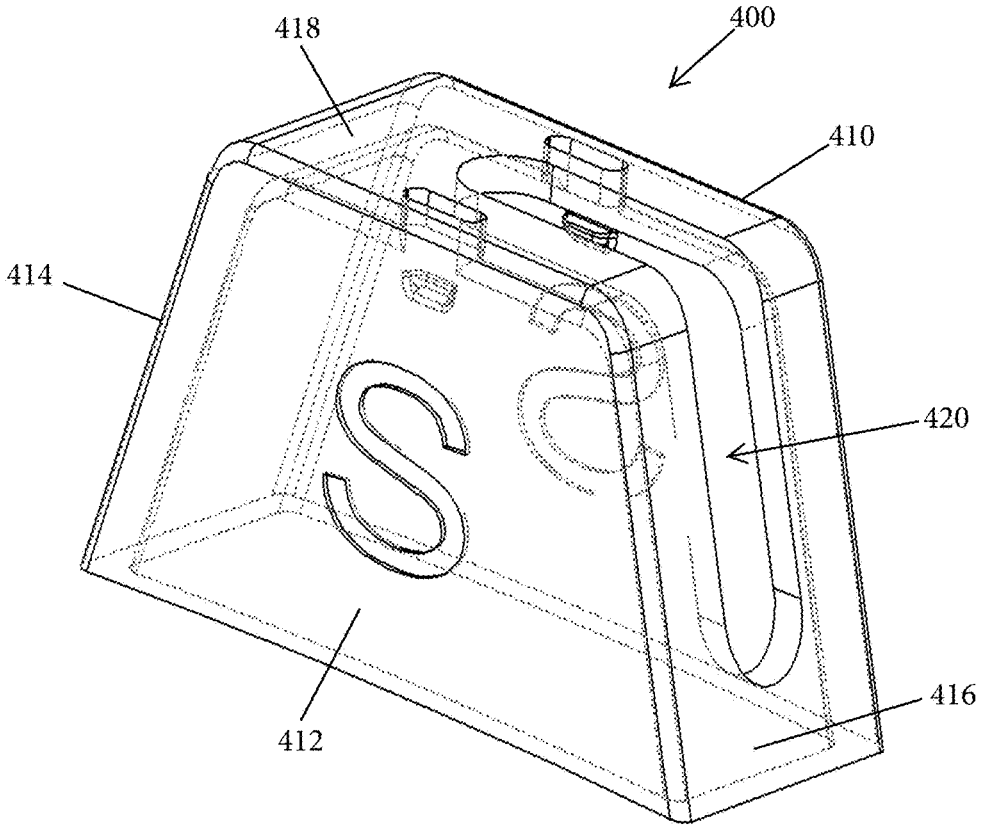
FIG. 9 is a perspective view of a top sizer for reception on the hook receiving body.

FIG. 9 also illustrates that a top sizer 400 can be placed over the hook receiving body 200 and is constructed to accommodate the hook. The top sizer 400 is thus a substantially hollow structure defined by five walls or faces. More particularly, the cross sizer 400 has first and second opposing side walls 410, 412; first and second end walls 414, 416 and a top wall 418. The first and second side walls 410, 412 are completely solid as is the end wall 414; however, the other end wall 416 and the top wall 418 have openings that define a slot 420 which at least substantially mirrors the hook receiving slot 235. In fact, the slot 420 also acts as a hook receiving slot in that the hook passes therethrough and must be able to move therein between the fully extended and fully collapsed positions of the hook.

Figure 10A:
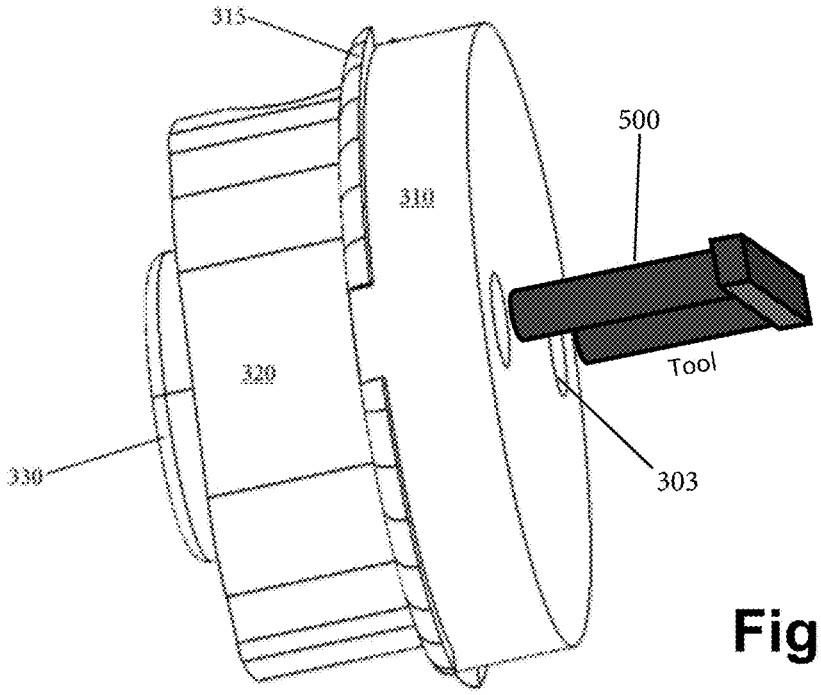
FIGS. 10A-C illustrate the use of a tool to stabilize the axle member while the hook is mated thereto.
Figure 10B:
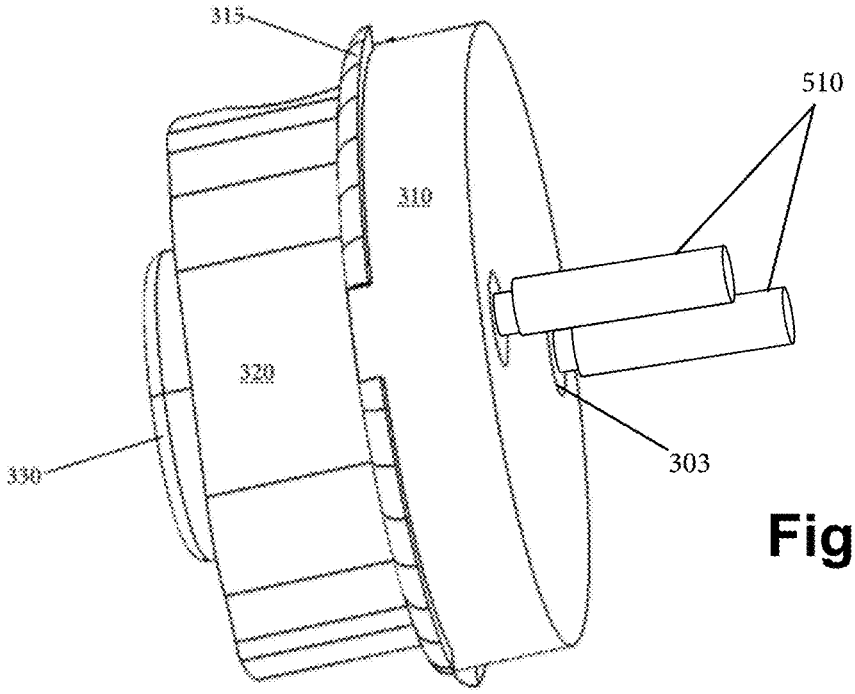
Figure 10C:
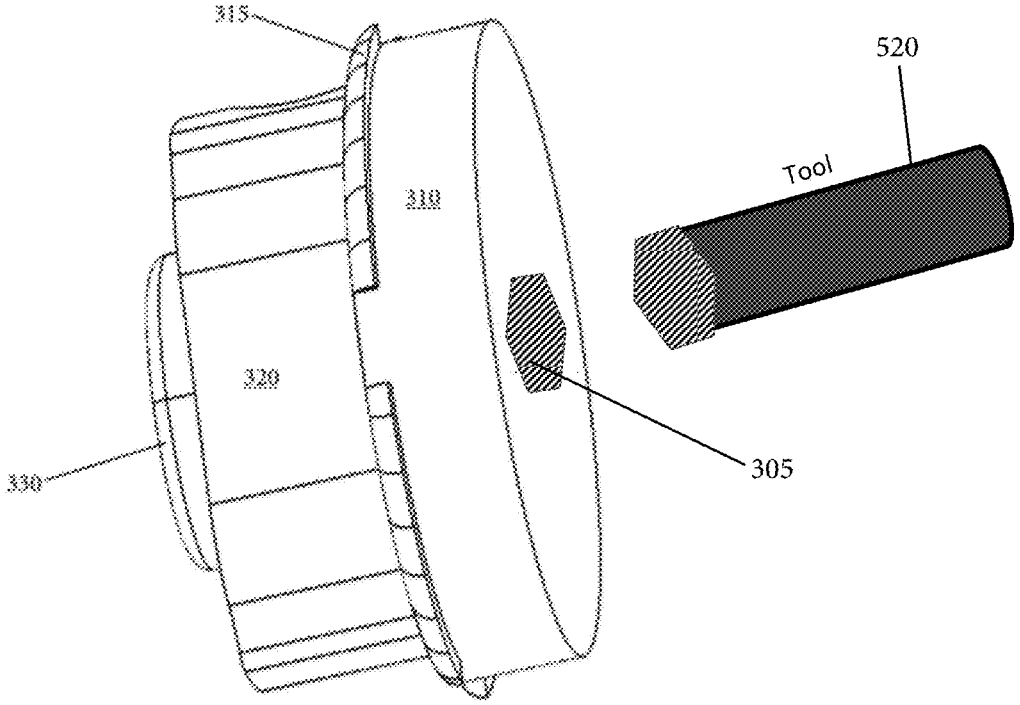

FIGS. 10A-C illustrate the use of a tool to stabilize the position of the axle member 300 prior to and during the mating of the hook 101 to the opening (recess) 301 of the axle member 300. More specifically, the opening 301 for the hook 101 should be facing upward vertically when the hook 101 is inserted into and mated with the opening 301 to couple the hook 101 to the axle member 300. While the hook 101 is being threadingly mated with the opening 301 of the axle member 300, it is desired to maintain the position of the axle member 300 and prevent rotation of the axle member 300. FIG. 10A shows the use of a tool 500 that has a pair of legs that are received within openings (recesses) 303 formed in the planar outer face of the first section 310 of the axle member 300. The insertion of the tool 500 into openings 303 fixes and maintains the axle member in a desired orientation (i.e., prevents rotation of the axle member 300). FIG. 10B shows the use of a mold component 510 that is similar and has a pair of protrusions (rods) that are received in the openings 303 to maintain the axle member in the desired orientation. FIG. 10C shows the insertion of a hexagonal shaped tool 520 into a hexagonal shaped opening (recess) 305.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A collapsible hook hanger comprising:

a hook having a threaded end;

a hanger body including a cross bar having a top edge;

a hook receiving body extending from the top edge of the cross bar, the hook receiving body being defined by a first side wall and an opposing second side wall, wherein an inner surface of the second side wall includes a recess that is located opposite a through hole formed in the first side wall, the hook receiving body having a hook receiving slot for receiving the hook; and an axle member having a first portion that is rotatably disposed within the through hole of the first side wall; a second portion that includes a threaded bore that is in communication with the hook receiving slot for receiving and mating to the threaded end of the hook; and a third portion that is rotatably received within and an outer face thereof seats against a floor of the recess formed in the second side wall such that an axial degree of travel, in a longitudinal direction, of the axle member is constrained by the floor of the recess; wherein the axle member includes a locking feature that interlocks with the first side wall resulting in the axle member being rotatably captured within the hook receiving body;

wherein the hook is rotatable between a first upright position and a second folded position;

wherein the locking feature comprises a peripheral rim that is formed about a periphery of the first portion;

wherein the peripheral rim is formed about a first face of the first portion on which the second portion is formed.

2. The collapsible hook hanger of claim 1, wherein the hook receiving slot is formed within one end wall and is open along a top of the hook receiving body.

3. The collapsible hook hanger of claim 1, wherein the third portion comprises an integral protrusion that extends outwardly from the second portion.

4. The collapsible hook hanger of claim 3, wherein the protrusion is circular shaped.

5. The collapsible hook hanger of claim 1, wherein the threaded bore is formed in one end of the second portion which has an oblong shape.

6. The collapsible hook hanger of claim 1, wherein the second portion is integral to and extends outwardly from the first portion.

7. The collapsible hook hanger of claim 1, wherein the first portion and third portions are circular shaped while the second portion has a non-circular shape.

8. The collapsible hook hanger of claim 1, wherein the peripheral rim comprises a circumferential locking ridge that extends circumferentially about the first portion.

9. The collapsible hook hanger of claim 8, wherein the circumferential locking ridge has a beveled edge and an undercut planar edge.

10. The collapsible hook hanger of claim 9, wherein the undercut planar edge seats against an inner surface of the first side wall when the axle member interlocks with the hook receiving body.

11. The collapsible hook hanger of claim 1, wherein a footprint of the third portion is less than a footprint of the second portion which is less than a footprint of the first portion.

12. The collapsible hook hanger of claim 1, wherein the axle member is configured such that when the third portion thereof is received within the recess, the threaded bore is aligned with the hook receiving slot and the first portion is rotatably captured within the through hole.

13. A collapsible hook hanger comprising:

a hook having a threaded end;

a hanger body including a cross bar having a top edge;

a hook receiving body extending from the top edge of the cross bar, the hook receiving body being defined by a first side wall and an opposing second side wall, wherein an inner surface of the second side wall includes a recess that is located opposite a through hole formed in the first side wall, the hook receiving body having a hook receiving slot for receiving the hook; and an axle member having a first portion that is rotatably disposed within the through hole of the first side wall; a second portion that includes a threaded bore that is in communication with the hook receiving slot for receiving and mating to the threaded end of the hook; and a third portion that is rotatably received within the recess in the second side wall; wherein the axle member includes a locking feature that interlocks with the first side wall resulting in the axle member being rotatably captured within the hook receiving body;

wherein the hook is rotatable between a first upright position and a second folded position;

wherein the locking feature comprises a flexible locking ridge that seats against an inner surface of the first side wall when the axle member is fully received within the hook receiving body and interlocks therewith while permitting free rotation of the axle member within the hook receiving body.

* * * * *